US008030830B2

(12) United States Patent
Passman et al.

(10) Patent No.: US 8,030,830 B2
(45) Date of Patent: Oct. 4, 2011

(54) IRIDIUM ALLOY FOR SPARK PLUG ELECTRODES

(75) Inventors: Eric P. Passman, Piscataway, NJ (US); Jeffrey T. Boehler, Holland, OH (US); Edgar A. Leone, Randolph, NJ (US)

(73) Assignee: FRAM Group IP LLC, Danbury, CT (US)

( * ) Notice: Subject to any disclaimer, the term of this patent is extended or adjusted under 35 U.S.C. 154(b) by 284 days.

(21) Appl. No.: 12/272,208

(22) Filed: Nov. 17, 2008

(65) Prior Publication Data

US 2009/0127996 A1 May 21, 2009

Related U.S. Application Data

(60) Provisional application No. 60/988,262, filed on Nov. 15, 2007.

(51) Int. Cl.
*H01T 13/20* (2006.01)

(52) U.S. Cl. ..... 313/141; 313/136; 445/7

(58) Field of Classification Search ..... 313/141–143, 313/136; 445/7
See application file for complete search history.

(56) References Cited

U.S. PATENT DOCUMENTS

| | | | | |
|---|---|---|---|---|
| 4,705,486 | A | 11/1987 | Myers et al. | |
| 5,456,624 | A | 10/1995 | Moore et al. | |
| 5,793,793 | A | 8/1998 | Matsutani et al. | |
| 5,973,443 | A | 10/1999 | Chang et al. | |
| 5,980,345 | A | 11/1999 | Chang et al. | |
| 5,998,913 | A | 12/1999 | Matsutani | |
| 6,071,163 | A | 6/2000 | Chang et al. | |
| 6,094,000 | A | 7/2000 | Osamura et al. | |
| 6,166,479 | A | 12/2000 | Matsutani et al. | |
| 6,597,089 | B2 | 7/2003 | Matsutani | |
| 6,664,719 | B2 | 12/2003 | Segawa et al. | |
| 6,720,099 | B1 | 4/2004 | Haltiner, Jr. | |
| 6,864,622 | B2 | 3/2005 | Matsutani et al. | |
| 6,869,328 | B2 | 3/2005 | Ulm et al. | |
| 2004/0140745 | A1 | 7/2004 | Hrastnik | |
| 2007/0114900 | A1 | 5/2007 | Lykowski | |
| 2007/0194681 | A1 * | 8/2007 | Yoshida | 313/141 |
| 2007/0222350 | A1 | 9/2007 | Lykowski et al. | |

FOREIGN PATENT DOCUMENTS

WO 01/18925 A1 3/2001

OTHER PUBLICATIONS

International Search Report for PCT/US2008/083776 dated Jun. 11, 2009.

Written Opinion of the International Searching Authority for PCT/US2008/083776 dated Jun. 11, 2009.

* cited by examiner

*Primary Examiner* — Nimeshkumar Patel
*Assistant Examiner* — Mary Ellen Bowman
(74) *Attorney, Agent, or Firm* — Cantor Colburn LLP

(57) ABSTRACT

A spark plug comprises a shell having a substantially cylindrical threaded portion for threadable engagement in a cylinder head of an internal combustion engine, an insulator disposed coaxially in the shell, a center electrode disposed coaxially in the insulator, a side ground electrode having a first end coupled to the shell and a second end facing an end of the center electrode to define a spark discharge gap therebetween, and an electrode tip portion secured to either the side ground electrode or the center electrode proximate the spark discharge gap. The tip portion is formed from an alloy comprising from about 60 to about 70 percent by weight iridium, from about 30 to about 35 percent by weight rhodium, from 0 to about 10 percent by weight nickel, from about 3500 to about 4500 parts per million tantalum, and from about 100 to about 200 parts per million zirconium.

19 Claims, 3 Drawing Sheets

IRIDIUM ALLOY FOR SPARK PLUG ELECTRODES

CROSS REFERENCE TO RELATED APPLICATIONS

This application claims the benefit of U.S. Provisional Patent Application Ser. No. 60/988,262 filed Nov. 15, 2007, the content of which are incorporated herein by reference thereto.

BACKGROUND

Exemplary embodiments of the present invention relate to spark plugs for use in internal combustion engines, and, more particularly, to spark plugs having an electrode which includes a tip portion that is capable of being resistance welded to nickel-based electrodes and resistant to wear in oxidizing conditions at high temperatures.

Spark plugs are widely used to ignite fuel in internal combustion engines. The electrodes of a spark plug are subject to intense heat and to an extremely corrosive environment generated by the formation of sparks and combustion of the air/fuel mixture. An electrode suffers whenever there is discharge during sparking, which can result in very high local temperatures and wear because of sputtering, melting, ablation, splashing, and particle erosion. In addition, the primary cause of wear for spark plugs is the failure of the electrodes caused by exposure to oxidizing conditions at elevated temperatures with high-sparking voltages. Oxidation proceeds from the surface of a healthy electrode, and spark discharge can remove weakened oxidized scales from the electrode surface causing wear and significantly reducing the life of the spark plug.

Thus, as an electrode becomes hotter, the speed of both sparking wear and oxidation wear accelerates. With combustion engines moving toward more lean burn to reduce emissions, and with cylinder pressures, compression ratios, and ignition voltages increasing, the reliability and lifetime performance of spark plugs are critical to accommodate further advances in engine development. Therefore, to provide durability and erosion resistance, the material used for spark plug electrodes should have a high melting point and be highly resistant to oxidation to withstand the high temperatures and corrosive environment that result from the chemical reactions between air, fuel, and fuel additives within the combustion chamber.

The manufacture of copper (Cu) and nickel (Ni) electrodes for spark plugs has been accomplished in various ways. For instance, U.S. Pat. No. 4,705,486 ("the '486 patent"), entitled "Method for Manufacturing a Center Electrode for a Spark Plug" the contents of which are incorporated herein in their entirety by reference thereto, discusses a method for manufacturing a center electrode that provides a degree of longevity for the spark plug. The center electrode is made from a good heat conducting material such as copper surrounded by a jacket of a corrosion resistant material such as nickel. Nickel, however, is susceptible to selective oxidation at high temperatures, which limits the life of the spark plug. Moreover, after a period of operating at higher temperatures in recirculation gases, corrosion/erosion can occur in the nickel-based electrode. Once corrosion has taken place, the electrical flow path will deteriorate and result in lower fuel efficiency.

To resist erosion caused during service in oxidizing conditions at elevated temperatures with high sparking voltages, heat- and wear-resistant tips consisting of high-cost precious metal alloys can be added to the discharge end of the spark plug electrode. While these spark plug electrode tips are tougher and more erosion resistant than the balance of the electrodes, they are situated at the points at which the spark crosses over between the sparking electrodes and therefore are among the most critical working parts of a spark plug.

The '486 patent, for example, provides a method of manufacturing an electrode for a spark plug in which a platinum (Pt) tip is attached to a body composed of a nickel alloy such as Inconel that is disposed about a copper core. Other illustrative examples of publications relating to various wear-resistant spark plug electrode tips, and to spark plugs including such electrode tips, may be found in U.S. Pat. Nos. 6,597,089, 6,166,479, 6,094,000, 6,071,163, 5,998,913, 5,980,345, 5,793,793, 5,973,443, and 5,456,624; PCT Pub. No. WO 01/18925; and U.S. Pat. Pub. Nos. 2004/0027042 and 2002/0171346, the contents of each of which are incorporated herein in their entirety by reference thereto Some wear-resistant spark plug electrode tips incorporate precious metals such as platinum because they provide reasonably good resistance to oxidation and erosion under exposure to a combustion chamber environment. Platinum, however, is susceptible to intergranular cracking and attack by oxidation and lead found in certain fuels being used with internal combustion engines. Progressive oxidation and crack growth can result in a substantial increase in electric resistance and thus breakdown voltage for ignition to continue. The erosion and deterioration of the platinum tip portion causes the sparking gap to widen, thus weakening the spark that the spark plug produces. Furthermore, platinum is a very expensive raw material, as are the other noble metals, and it is therefore advantageous to strictly control the amount of noble metal which is incorporated into each spark plug.

Iridium (Ir) has shown excellent resistance to attack by a wide range of molten metals. For instance, iridium is superior to platinum in withstanding attack by lead. Furthermore, iridium can provide superior wear resistance with a narrower center diameter, which allows for improved ignition. The coefficient of thermal expansion of iridium, however, differs significantly from nickel. Under high thermal stress, this difference can cause weakening or fracture to occur at the area where an iridium-based electrode tip portion and a nickel-based electrode are joined as the tip portion and electrode heat up during use of the spark plug, and may even lead to physical separation of the noble metal and base metal. Thus, iridium and its alloys have heretofore been extremely difficult to resistance weld or otherwise secure to an electrode comprised of nickel-based substrate alloys without experiencing gradually cracking and/or breaking at the joint between these components, particularly in side electrodes where the thermal stresses are most severe.

Although various designs for spark plugs having wear-resistant electrode tips are known, the inventors herein have recognized a need for a spark plug having an electrode construction that allows for a long life of operation before the spark plug requires replacing, is highly wear-resistant and resistant to oxidation at high operating temperatures, and can provide a reliable, oxidation-resistant weld between the tip portion and the substrate portion.

SUMMARY

Exemplary embodiments of the present invention relate to a spark plug that comprises a shell having a substantially cylindrical threaded portion for threadable engagement in a cylinder head of an internal combustion engine, an insulator disposed coaxially in the shell, a center electrode disposed coaxially in the insulator, a side ground electrode having a first end coupled to the shell and a second end facing an end of the center electrode to define a spark discharge gap therebetween, and an electrode tip portion secured to either the side ground electrode or the center electrode proximate the spark discharge gap. The tip portion is formed from an alloy comprising from about 60 to about 70 percent by weight iridium (Ir), from about 30 to about 35 percent by weight rhodium (Rh), from 0 to about 10 percent by weight nickel (Ni)), from about 3500 to about 4500 parts per million tantalum, and from about 100 to about 200 parts per million zirconium.

Exemplary embodiments of the present invention relate to a spark plug that comprises a shell having a substantially cylindrical threaded portion for threadable engagement in a cylinder head of an internal combustion engine, an insulator disposed coaxially in the shell, a center electrode disposed coaxially in the insulator, a side ground electrode having a first end coupled to the shell and a second end facing an end of the center electrode to define a spark discharge gap therebetween, and an electrode tip portion secured to either the side ground electrode or the center electrode proximate the spark discharge gap. The tip portion is formed from an alloy comprising from about 60 to about 70 percent by weight iridium (Ir), from about 30 to about 35 percent by weight rhodium (Rh), from 0 to about 10 percent by weight nickel (Ni), and from about 50 to about 100 parts per million cerium.

Exemplary embodiments of the present invention also relate to a spark plug that comprises a center electrode disposed coaxially in an insulator, a side ground electrode facing the center electrode to define a spark discharge gap therebetween, and an electrode tip portion secured to either the side ground electrode or the center electrode proximate the spark discharge gap. The tip portion is formed from an alloy comprising from about 60 to about 70 percent by weight iridium, from about 30 to about 35 percent by weight rhodium, from 0 to about 10 percent by weight nickel, from about 3500 to about 4500 parts per million tantalum, and from about 100 to about 200 parts per million zirconium.

Exemplary embodiments of the present invention also relate to a spark plug that comprises a center electrode disposed coaxially in an insulator, a side ground electrode facing the center electrode to define a spark discharge gap therebetween, and an electrode tip portion secured to either the side ground electrode or the center electrode proximate the spark discharge gap. The tip portion is formed from an alloy comprising from about 60 to about 70 percent by weight iridium, from about 30 to about 35 percent by weight rhodium, and from about 50 to about 100 parts per million cerium.

Exemplary embodiments of the present invention also relate to a wear-resistant electrode tip portion for securing to a spark plug electrode. The tip portion comprises from about 60 to about 70 percent by weight iridium, from about 30 to about 35 percent by weight rhodium, from 0 to about 10 percent by weight nickel, from about 3500 to about 4500 parts per million tantalum, and from about 100 to about 200 parts per million zirconium.

Exemplary embodiments of the present invention also relate to a wear-resistant electrode tip portion for securing to a spark plug electrode. The tip portion comprises from about 60 to about 70 percent by weight iridium, from about 30 to about 35 percent by weight rhodium, and from about 50 to about 100 parts per million cerium.

Exemplary embodiments of the present invention also relate to a method for constructing an electrode for a spark plug. The method comprises obtaining an electrode tip portion formed from an alloy comprising from about 60 to about 70 percent by weight iridium, from about 30 to about 35 percent by weight rhodium, from 0 to about 10 percent by weight nickel, from about 3500 to about 4500 parts per million tantalum, and from about 100 to about 200 parts per million zirconium. The method further comprises placing the tip portion in a welding fixture. The method further comprises aligning the tip portion with the electrode. The method further comprises welding the tip portion to the electrode.

Exemplary embodiments of the present invention also relate to a method for constructing an electrode for a spark plug. The method comprises obtaining an electrode tip portion formed from an alloy comprising from about 60 to about 70 percent by weight iridium, from about 30 to about 35 percent by weight rhodium, from 0 to about 10 percent by weight nickel, and from about 50 to about 100 parts per million cerium. The method further comprises placing the tip portion in a welding fixture. The method further comprises aligning the tip portion with the electrode. The method further comprises welding the tip portion to the electrode.

DESCRIPTION OF EXEMPLARY EMBODIMENTS

Figure 1:
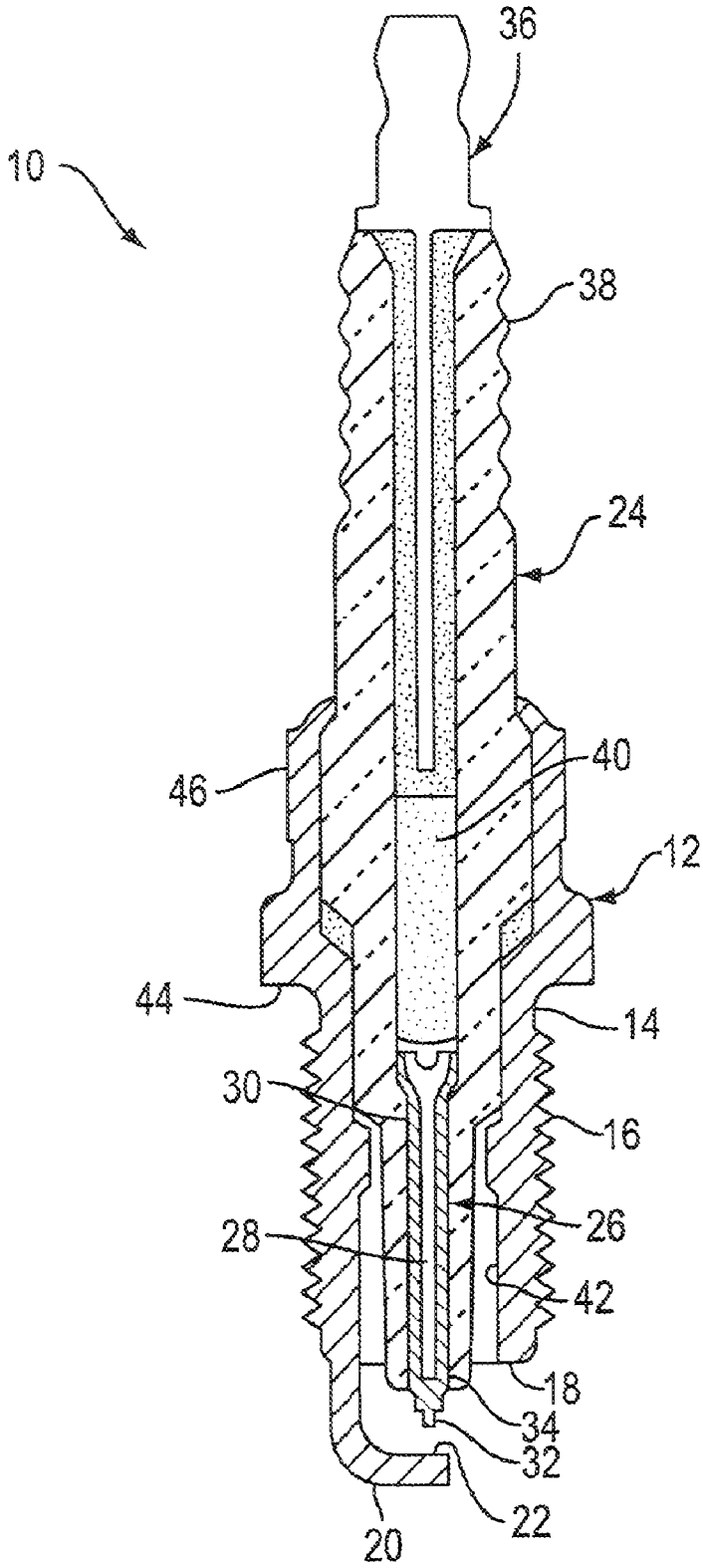
FIG. 1 is a cross-sectional view of a spark plug in accordance with an exemplary embodiment of the present invention.
Figure 2:
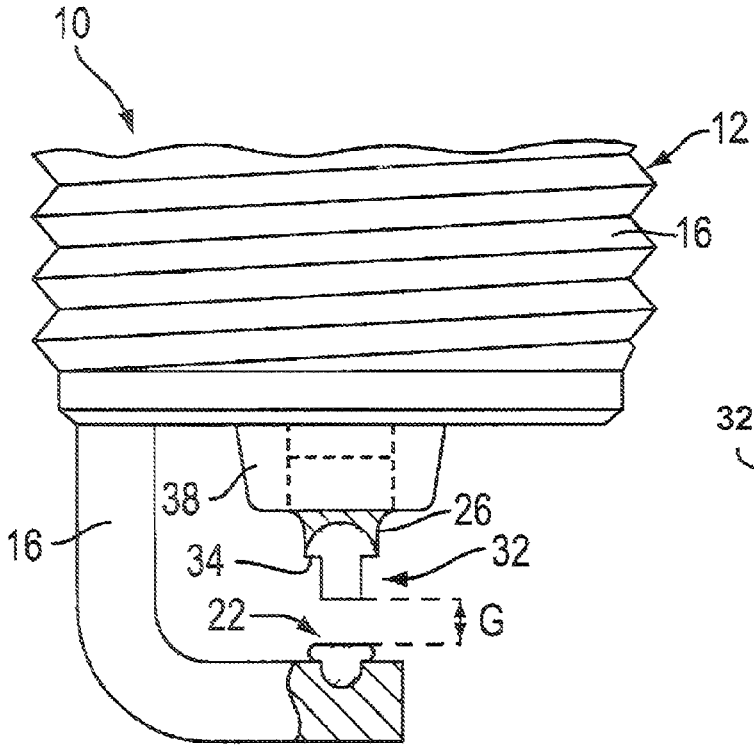
FIG. 2 is a side elevational detail view, partially broken away and partially shown in cross-section, of an end portion of the exemplary spark plug of FIG. 1.

Referring to FIGS. 1-4, a spark plug in accordance with an exemplary embodiment of the present invention is shown generally at 10. Spark plug 10 includes an annular metal casing or shell 12 having a cylindrical base 14 with external threads 16 formed thereon for threadable engagement in a cylinder head (not shown). Cylindrical base 14 of spark plug shell 12 has a generally flattened lower surface 18. A ground or side electrode 20, formed from nickel (Ni) or a nickel-based alloy, is welded on to lower surface 18 of threaded base 14. Throughout the present description of exemplary embodiments, the terms "ground electrode" and "side electrode" refer to the same component, and these terms are used interchangeably.

Spark plug 10 further includes a hollow ceramic insulator 24 disposed concentrically within shell 12 and a center electrode 26 disposed concentrically within insulator 24. In the present exemplary embodiment, center electrode 26 includes a central core 28 that is made of a thermally and electrically conductive material, such as copper (Cu) or a copper-based alloy, and an outer cladding 30 that is formed from a nickel-based alloy. In exemplary embodiments, cladding 30 can be formed from commercially available nickel-based alloys such as Inconel 600 or 601, or Hoskins 831 or 592.

In the present exemplary embodiment, ground electrode 16 has a wear-resistant electrode tip portion 22 affixed thereon (by, for example, brazing, resistance welding, laser welding and equivalents thereof) adjacent the end thereof. Center electrode 26 also has a wear-resistant electrode tip portion 32 affixed to a lower end 34 thereof. Electrode tips 22 and 32, shown in the shape of a rivet in FIGS. 1-4, are comprised of materials that can provide a reliable, oxidation-resistant weld with a nickel-based alloy, as will be further described herein.

An electrically conductive insert or rod 36 fits into the upper end 38 of insulator 24 opposite center electrode 26, and a refractory glass-carbon composite material is disposed within insulator 24 between the lower end of insert 36 and center electrode 26 to provide an internal resistor 40 with spark plug 10.

As illustrated in FIG. 1, spark plug shell 12 is a substantially cylindrical sleeve having a hollow bore 42 formed therethrough. As noted above, spark plug shell 12 includes cylindrical base portion 14 which generally has threads 16 formed on the exterior surface thereof. Spark plug shell 12 includes a sealing surface 44 for contacting a cylinder head (not shown) and, on the shell above the sealing surface, a generally hexagonal boss 46 for allowing spark plug 10 to be grasped and turned by a conventional spark plug socket wrench for installation or removal thereof.

During operation, it is desirable to maintain the spacing, or gap G, between center electrode 26 and ground or side electrode 20 throughout the life of spark plug 10.

Figure 5:
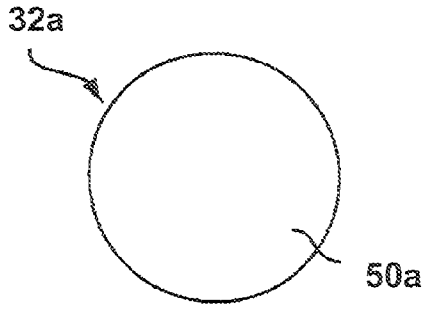
FIG. 5 is an elevational view of an exemplary embodiment of a spherical electrode tip.
Figure 3:
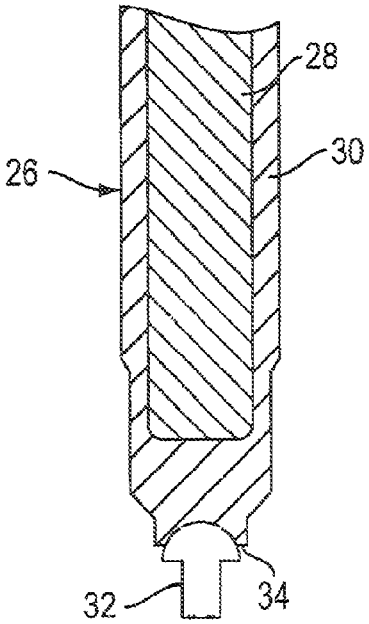
FIG. 3 is a cross-sectional detail view of a center electrode which is one component of the exemplary spark plug of FIG. 1.
Figure 4:
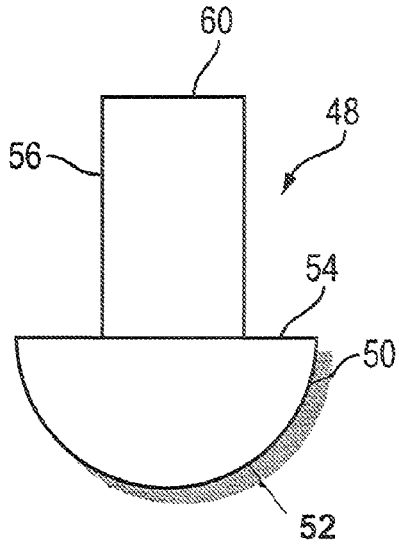
FIG. 4 is a vertical cross-sectional detail view of an exemplary embodiment of a rivet-shaped electrode tip.

In exemplary embodiments, wear-resistant tip 32 of center electrode 26 can be formed in the shape of a post, rivet, or sphere. Spark plugs generally using fine wire rivet firing tips and methods of attaching such rivet tips to electrodes are described generally in U.S. Pat. Nos. 5,456,624 and 6,071,163, the contents of which are incorporated herein in their entirety by reference thereto. In the present exemplary embodiment, as shown in FIG. 4, wear-resistant electrode tip 32 is provided in the form of a rivet 48 that includes a head 50 having a continuous, semi-spherical outer surface 52 and a flat portion 54 opposite the outer surface of the head. A generally cylindrical shank 56 extends from the flat portion 54 and terminates in a generally flattened base 60. In alternative exemplary embodiments in which wear-resistant tip 32 takes the form of a post, it can resemble shank 56 of rivet 48, with head 50 removed therefrom. In the alternative exemplary embodiment illustrated in FIG. 5, electrode tip 32*a* is formed in the shape of a sphere 50*a*. In non-limiting exemplary embodiments, the diameter of the sphere may vary significantly, but can be in the range from about 0.38 to about 1.14 mm, and, in non-limiting exemplary embodiments, about 0.80 mm.

In exemplary embodiments, each wear-resistant spark plug electrode tip can be formed from a wire made of an alloy comprising iridium (Ir) and rhodium (Rh). Such an electrode tip can exhibit improved resistance to both sparking discharge and oxidation, as well as enhanced durability at high temperatures. Specifically, iridium, which has a high melting point, and rhodium both provide excellent sparking wear resistance, and the addition of rhodium as an alloying metal element in an iridium-based alloy is effective in improving the oxidation resistance of iridium and inhibiting volatility. In exemplary embodiments, the electrode tips can also comprise small or micro amounts of tantalum (Ta), zirconium (Zr), and/or cerium (Ce). These alloying elements additions can help to further ensure each electrode tip portion against welding cracks that might occur due to differing coefficients of thermal expansion between the nickel-based electrode substrate and the iridium-rhodium tip portions.

In exemplary embodiments, the alloy for an electrode tip can comprise iridium in a range from about 60 to about 70 percent by weight, rhodium in a range from about 30 to about 35 percent by weight, and nickel in a range from 0 to about 10 percent by weight, as well micro additions of tantalum in a range of about 3500 to about 4500 ppm, zirconium in a range of about 100 to about 200 ppm, and/or cerium in a range of about 50 to about 100 ppm. A non-limiting exemplary embodiment of a mixture that is usable for the electrode tip alloy is 65 percent by weight iridium, 35 percent by weight rhodium, 4000±500 ppm tantalum, and 150±50 ppm zirconium. A second non-limiting exemplary embodiment of a mixture that is usable for the electrode tip alloy is 70 percent by weight iridium, 30 percent by weight rhodium, and 75±25 ppm cerium. Another non-limiting exemplary embodiment of a mixture which is usable for the electrode tip alloy is 60 percent by weight iridium, 30 percent by weight rhodium, 10 percent by weight nickel, 4000±500 ppm tantalum, and 150±50 ppm zirconium. Yet another non-limiting exemplary embodiment of a mixture that is usable for the electrode tip alloy is 60 percent by weight iridium, 30 percent by weight rhodium, 10 percent by weight nickel, and 75±25 ppm cerium.

Exemplary processes of forming a spherical shaped electrode tip portion and welding it to an electrode substrate are described in U.S. Pat. No. 5,980,345, the contents of which are incorporated herein in their entirety by reference thereto. An exemplary process of forming a rivet-shaped tip portion and welding it to an electrode substrate in accordance with the present invention will now be described. A length of wire made from one of the aforementioned exemplary iridium-rhodium alloys is cut to a predetermined length. A shank end of the rivet is then finished and formed, and a head of the rivet is formed in a conventional high speed ball former. The electrode substrate may be formed as described in U.S. Pat. No. 4,705,486.

Figure 6:
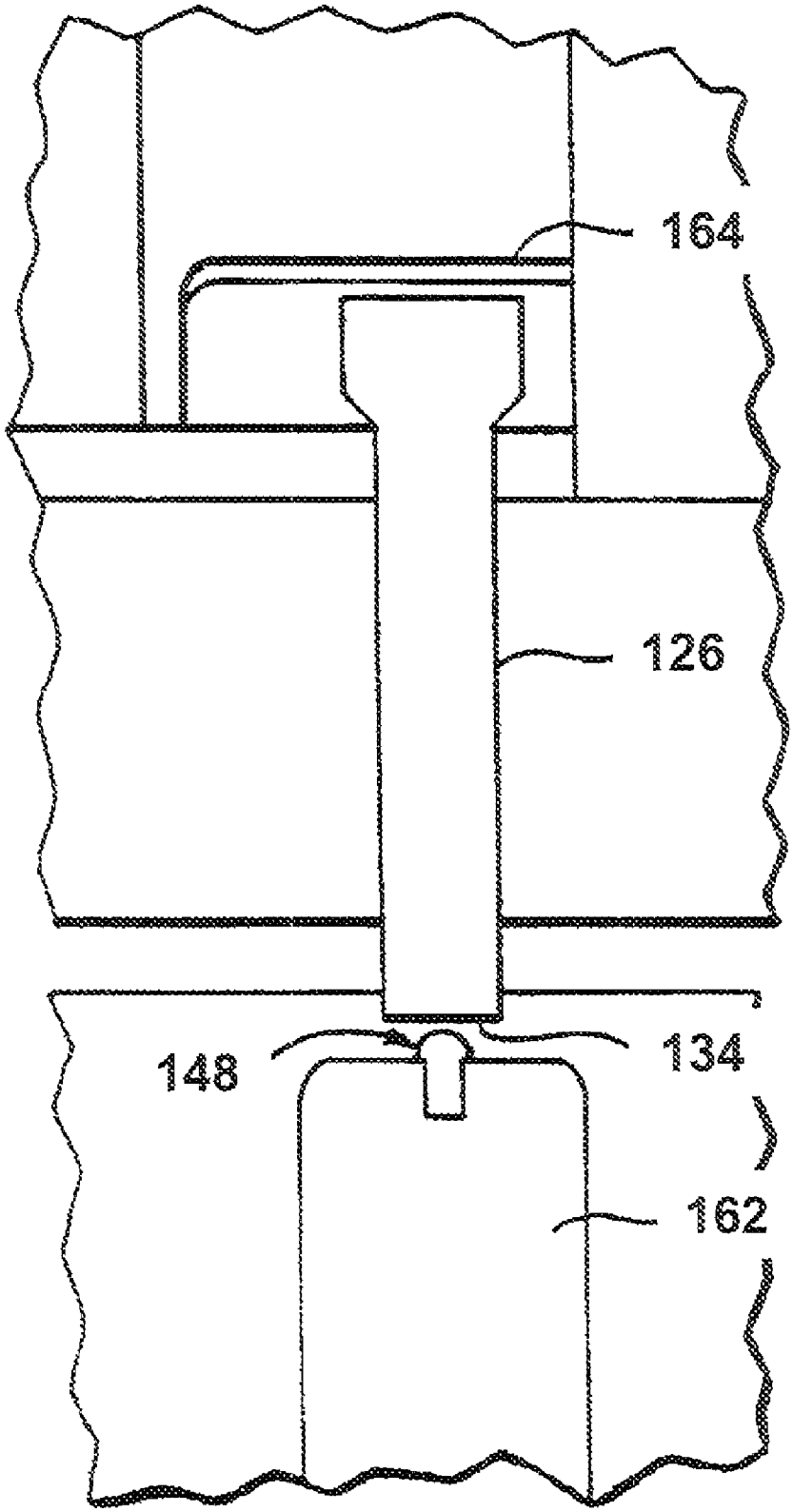
FIG. 6 is a schematic view of an exemplary embodiment of a resistance welding machine.

As indicated schematically in FIG. 6, which shows an exemplary resistance welding machine having a firing tip of a rivet-shaped electrode tip 148 and an electrode substrate 126 in the positions they assume just before being brought into welding contact, the electrode substrate and the rivet are clamped respectively in a lower welding head 162 and an upper welding head 164. In such a conventional electric resistance welding machine, upper welding head 164 is movable relative to lower welding head 162. Upper welding head 164 has a recess formed in an upper surface thereof for holding and maintaining rivet 148 stationary during the welding process. Electrode substrate 126 may be either a portion of a center electrode or a side electrode.

Upper welding head 164 is then moved toward lower welding head 162 until an outer surface of rivet 148 makes an initial point contact with a lower end 134 of electrode substrate 126. An electrical current is then applied through parts 148, 126 that varies from 500 to 1,000 amps, and upper welding head 164 forces electrode substrate 126 against rivet 148 with a force that varies from about 10 to about 30 pounds. This welding operation generates an alloying of the iridium-rhodium alloy of rivet 148 and a nickel-based alloy cladding of electrode substrate 126 at the weld interface. The outer surface of rivet 148 penetrates into lower end 134 to a depth that is controlled by varying the current and the applied force between the two parts during application of the current, and embeds the outer surface into the cladding about 0.006 inches to about 0.012 inches deep, thereby forcing the nickel-based material of the cladding, which is displaced by a head of rivet 148, to flow around the outer surface to capture the rivet. In this manner, rivet 148 becomes securely fixed to electrode substrate 126. If a flat electrode tip is desired, the tip may, optionally, be flattened in place on the finished electrode part. The finished part is then removed from the welding machine and may be assembled into a finished spark plug following standard procedures and using standard components for the balance of the parts.

In exemplary embodiments, the resistance welding process can be used to achieve better bonding strength between the iridium-rhodium alloy tip and the nickel alloy electrode as a result of the inter-diffusion of nickel with micro additions of tantalum, zirconium, and/or cerium. Intermediate phases can be formed between the nickel alloy electrode and tantalum, zirconium, and/or cerium that will minimize the mismatch in the thermal expansion coefficient between iridium and the nickel alloy. Thus, these small additions serve to better match the coefficient of thermal expansion of the electrode substrate to the tip portion to ensure against cracks and stress fractures as the electrode goes from room temperature to an operating temperature during use.

Thus, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular exemplary embodiments disclosed herein, but that the invention will include all embodiments falling within the scope of the appended claims and their legal equivalence.

What is claimed is:

1. A spark plug, comprising:

a shell having a substantially cylindrical threaded portion for threadable engagement in a cylinder head of an internal combustion engine;

an insulator disposed coaxially in the shell;

a center electrode disposed coaxially in the insulator;

a side ground electrode having a first end coupled to the shell and a second end facing an end of the center electrode to define a spark discharge gap therebetween; and an electrode tip portion secured to either the side ground electrode or the center electrode proximate the spark discharge gap, the tip portion being formed from an alloy consisting essentially of from about 60 to about 70 percent by weight iridium, from about 30 to about 35 percent by weight rhodium, from 0 to about 10 percent by weight nickel, from about 3500 to about 4500 parts per million tantalum, and from about 100 to about 200 parts per million zirconium.

2. The spark plug of claim 1, wherein the alloy comprises about 65 percent by weight iridium, about 35 percent by weight rhodium.

3. The spark plug of claim 1, wherein the alloy consists essentially of 65 percent by weight iridium, 35 percent by weight rhodium, 4000 parts per million tantalum, and 200 parts per million zirconium.

4. The spark plug of claim 1, wherein the alloy comprises about 60 percent by weight iridium, about 30 percent by weight rhodium, and about 10 percent by weight nickel.

5. A spark plug, comprising:

a shell having a substantially cylindrical threaded portion for threadable engagement in a cylinder head of an internal combustion engine;

an insulator disposed coaxially in the shell;

a center electrode disposed coaxially in the insulator;

a side ground electrode having a first end coupled to the shell and a second end facing an end of the center electrode to define a spark discharge gap therebetween; and an electrode tip portion secured to either the side ground electrode or the center electrode proximate the spark discharge gap, the tip portion being formed from an alloy consists essentially of from about 60 to about 70 percent by weight iridium, from about 30 to about 35 percent by weight rhodium, from 0 to about 10 percent by weight nickel, and from about 50 to about 100 parts per million cerium.

6. The spark plug of claim 5, wherein the alloy comprises about 70 percent by weight iridium, and about 30 percent by weight rhodium.

7. The spark plug of claim 5, wherein the alloy comprises about 60 percent by weight iridium, about 30 percent by weight rhodium, and about 10 percent by weight nickel.

8. The spark plug of claim 5, wherein the alloy consists essentially of 70 percent by weight iridium, 30 percent by weight rhodium, and 100 parts per million cerium.

9. The spark plug of claim 5, wherein the alloy consists essentially of 60 percent by weight iridium, 30 percent by weight rhodium, 10 percent by weight nickel, and 100 parts per million cerium.

10. The spark plug of claim 1, wherein the tip portion is secured to the side ground electrode.

11. The spark plug of claim 1, wherein the tip portion is secured to the center electrode.

12. The spark plug of claim 1, wherein the tip portion is secured to the side ground electrode and a second electrode tip portion is secured to the center electrode.

13. The spark plug of claim 1, wherein the tip portion is secured to the side ground electrode or the center electrode by resistance welding or laser welding.

14. The spark plug of claim 12, wherein the second tip portion is secured to the center electrode by resistance welding or laser welding.

15. The spark plug of claim 1, wherein the end of the center electrode protrudes from the insulator.

16. A wear-resistant electrode tip portion for securing to a spark plug electrode, the tip portion consisting essentially of:

from about 60 to about 70 percent by weight iridium;

from about 30 to about 35 percent by weight rhodium;

from 0 to about 10 percent by weight nickel;

from about 3500 to about 4500 parts per million tantalum; and from about 100 to about 200 parts per million zirconium.

17. A wear-resistant electrode tip portion for securing to a spark plug electrode, the tip portion consisting essentially of:

from about 60 to about 70 percent by weight iridium;

from about 30 to about 35 percent by weight rhodium;

from 0 to about 10 percent by weight nickel; and from about 50 to about 100 parts per million cerium.

18. The tip portion of claim 16, wherein the tip portion is rivet-shaped.

19. The tip portion of claim 16, wherein the tip portion is substantially spherical.

* * * * *